US008398261B2

(12) United States Patent
Nall et al.

(10) Patent No.: US 8,398,261 B2
(45) Date of Patent: Mar. 19, 2013

(54) LIGHTING STRIPS WITH IMPROVED MANUFACTURABILITY

(75) Inventors: Jeffrey Nall, Brecksville, OH (US); Tomislav Stimac, Concord, OH (US); Chenyang Li, ShangHai (CN); Matthew Mrakovich, Streetsboro, OH (US); Ronald Brengartner, Strongsville, OH (US)

(73) Assignee: GE Lighting Solutions LLC, Cleveland, OH (US)

( * ) Notice: Subject to any disclaimer, the term of this patent is extended or adjusted under 35 U.S.C. 154(b) by 1075 days.

(21) Appl. No.: 11/323,637

(22) Filed: Dec. 30, 2005

(65) Prior Publication Data

US 2007/0153508 A1 Jul. 5, 2007

(51) Int. Cl.
*F21S 4/00* (2006.01)

(52) U.S. Cl. ..... 362/219; 362/225; 315/294

(58) Field of Classification Search ..... 362/249, 362/219, 225, 227, 231, 238, 252, 800, 806, 362/812; 439/402–405, 426; 40/541, 542, 40/581

See application file for complete search history.

(56) References Cited

U.S. PATENT DOCUMENTS

| | | | | |
|---|---|---|---|---|
| 4,631,650 | A | 12/1986 | Ahroni | |
| 5,278,432 | A * | 1/1994 | Ignatius et al. | 257/88 |
| 5,672,000 | A | 9/1997 | Lin | |
| 6,367,952 | B1 | 4/2002 | Gibboney | |
| 6,505,956 | B1 | 1/2003 | Priddy et al. | |
| 6,660,935 | B2 | 12/2003 | Southard et al. | |
| 6,933,707 | B2 * | 8/2005 | Allen | 323/265 |
| 7,114,841 | B2 * | 10/2006 | Aanegola et al. | 362/640 |
| 7,160,140 | B1 * | 1/2007 | Mrakovich et al. | 439/417 |
| 7,210,957 | B2 * | 5/2007 | Mrakovich et al. | 439/404 |
| 7,211,967 | B2 * | 5/2007 | Lin | 315/291 |

(Continued)

FOREIGN PATENT DOCUMENTS

WO WO 03/088421 10/2003

OTHER PUBLICATIONS

National Semiconductor Corporation, "LM117/LM317A/LM317 3-Terminal Adjustable Regulator," 17 pp., 1996, available at www.datasheetcatalog.com.

(Continued)

*Primary Examiner* — Hargobind S Sawhney
(74) *Attorney, Agent, or Firm* — Fay Sharpe LLP

(57) ABSTRACT

In a lighting strip (8, 80, 380), a flexible electrically insulated cable (10, 110, 410) includes spaced apart parallel electrical conductors (12, 14, 112, 114, 118, 412, 414, 418$_1$, 418$_2$, 418$_3$, 418$_4$) bound together by electrical insulation (16, 116, 416) as a cable. The electrical conductors include power conductors (12, 14, 112, 114, 412, 414). A plurality of lighting units (20, 120, 220, 320, 420) secured to and spaced apart along the flexible electrically insulated cable each include: (i) one or more light emitting devices (24, 124*a*, 124*b*, 124*c*, 124*d*, 224*b*1, 224*b*2, 224*b*3, 224*c*1, 224*c*2, 224*c*3, 224*d*1, 224*d*2, 224*d*3, 424$_1$, 424$_2$, 424$_3$, 424$_4$); (ii) power regulating electrical circuitry (40, 140, 240, 340, 440); and (iii) insulation displacing conductors (28, 30, 128*a*, 128*b*, 128*c*, 128*d*, 130*a*, 130*b*, 130*c*, 130*d*, 391, 392, 393, 500, 550, 600) connecting the lighting unit with at least the power conductors. The insulation displacing conductors (500, 550, 600) may be interchangeable.

16 Claims, 14 Drawing Sheets

U.S. PATENT DOCUMENTS

| | | | | |
|---|---|---|---|---|
| 7,241,031 | B2 * | 7/2007 | Sloan et al. | 362/373 |
| 2003/0063463 | A1 | 4/2003 | Sloan et al. | |
| 2004/0115984 | A1 * | 6/2004 | Rudy et al. | 439/405 |
| 2004/0245946 | A1 * | 12/2004 | Halter | 315/312 |
| 2005/0030765 | A1 * | 2/2005 | Southard et al. | 362/559 |
| 2005/0068459 | A1 * | 3/2005 | Holmes et al. | 348/372 |
| 2005/0207151 | A1 | 9/2005 | Aanegola | |
| 2005/0207196 | A1 * | 9/2005 | Holmes et al. | 363/126 |
| 2005/0231943 | A1 | 10/2005 | Sloan et al. | |
| 2005/0231947 | A1 | 10/2005 | Sloan et al. | |

OTHER PUBLICATIONS

Infineon Technologies, "LED Driver BCR402R," Infineon Technolgies AG, 4 pp., 2001.
Tyco Electronics, "MTA-50 IDC Connector System," 2 pp., 2001.
Infineon Technolgies, "LED Drive BCR402U," 6 pp., 2004, available at www.datasheetcatalog.com.
SloanLED, "ChannelLED3 Installation Guide", 10 pp., 2003.
SloanLED, "ChanneLED4 Constant Current," 2 pp., 2003.

* cited by examiner

LIGHTING STRIPS WITH IMPROVED MANUFACTURABILITY

BACKGROUND

The following relates to the lighting arts. It especially relates to flexible lighting strips for channel lettering, border lighting, and so forth. However, the following will also find application in conjunction with other lighting applications.

Light emitting devices, such as light emitting diodes, are suitable for use in lighting strips. For example, Southard et al., Int'l. Appl. Publ. No. WO 02/097770 A2 illustrates lighting strips including a flexible insulated cable with positive and negative conductors and modules bearing light emitting diodes. Each module includes insulation-displacing conductors that pierce the insulation and make electrical contact with the positive and negative conductors to provide electrical power to the module. By spacing the light emitting diode-bearing modules along the flexible insulated cable, a flexible lighting strip is formed.

Priddy et al., U.S. Pat. No. 6,505,956 illustrate lighting strips formed by daisy-chaining small light emitting diode-bearing printed circuit boards using flexible connecting conductors disposed between the printed circuit boards. Voltage-dividing resistors are included on each printed circuit so that the applied voltage can be larger than the forward voltage of the light emitting diodes. The difference between the applied voltage and the forward voltage of the light emitting diodes is accommodated by heat dissipation in the voltage-dividing resistors. The energy efficiency of such lighting strips is degraded by the power dissipation in the resistors.

Lin, U.S. Pat. No. 5,672,000 discloses a lighting strip including a flexible insulated cable with positive and negative conductors and a third series conductor, and modules bearing light emitting diodes that make electrical contact with the conductors of the insulated cable. A series-parallel lighting strip can be formed having a number of series portions in which each series portion includes a number of spaced apart modules. The first module of a series portion has insulation displacing conductors (IDC's) contacting the positive and series conductors; the next one or more modules have both IDC's connecting with the series conductor; and the last module in the series portion has IDC's contacting the series and negative conductors. The voltage applied between the positive and negative conductors drives the modules of each series portion electrically in series, so that the voltage across the series portion is the sum of the voltages across the modules in the series. Such series-parallel lighting strips can have a relatively high driving voltage and correspondingly lower driving electrical current, thus enabling a longer operable lighting strip length.

However, the lighting strip of Lin has certain disadvantages. The voltage across a given light emitting diode is controlled by the difference in applied driving voltage and by the voltage drops across each module of the series portion containing the given light emitting diode. These voltage drops, in turn, are affected by various factors which may vary with manufacturing variations and/or over time. For example, as the light emitting diodes heat up due to resistive heating during operation, the effective forward voltage increases due to a heat-induced increase in electrical resistance. If one of the modules fails, the remaining light emitting diodes will experience changed driving voltage.

More generally, existing lighting strips are sensitive to component variations. For example, in addition to the above-mentioned heating and light emitting diode failure issues, the present inventors have found that variability of forward voltage values in commercial lots of light emitting diodes is large enough that not all the light emitting diodes can be used in a parallel or series-parallel lighting strip such as that of Lin. Light emitting diodes at the high and low ends of the forward voltage range must be discarded, since their inclusion in a parallel or series portion or a series-parallel lighting strip would produce an unacceptable redistribution of voltage.

Another manufacturing issue with existing lighting strips is the number of different parts involved in lighting strip construction. Typically, the lighting strip includes light emitting devices, connectors, and two or more different types of insulation displacing conductors (IDC's). This multiplicity of different types of parts complicates manufacturing including the stocking of parts for the lighting strip.

BRIEF SUMMARY

According to one aspect, a lighting strip is disclosed. A flexible electrically insulated cable includes a plurality of spaced apart parallel electrical conductors bound together by electrical insulation as a cable. The electrical conductors include at least first and second power conductors. A plurality of lighting units are secured to and spaced apart along the flexible electrically insulated cable. Each lighting unit includes: (i) one or more light emitting devices; (ii) power regulating electrical circuitry configured to regulate electrical power delivered to the lighting unit from the power conductors of the cable; and (iii) insulation displacing conductors connecting the lighting unit with at least the first and second power conductors.

According to another aspect, a lighting strip is disclosed. A flexible electrically insulated cable includes a plurality of spaced apart parallel electrical conductors bound together by electrical insulation as a cable. The electrical conductors include at least first and second power conductors. A plurality of lighting units are secured to and spaced apart along the flexible electrically insulated cable. Each lighting unit includes: (i) one or more light emitting devices; and (ii) a plurality of interchangeable insulation displacing conductors connecting the lighting unit with at least the first and second power conductors.

Numerous advantages and benefits of the present invention will become apparent to those of ordinary skill in the art upon reading and understanding the present specification.

BRIEF DESCRIPTION OF THE DRAWINGS

The invention may take form in various components and arrangements of components, and in various process operations and arrangements of process operations. The drawings are only for purposes of illustrating preferred embodiments and are not to be construed as limiting the invention.

DETAILED DESCRIPTION OF PREFERRED EMBODIMENTS

Figure 1A:
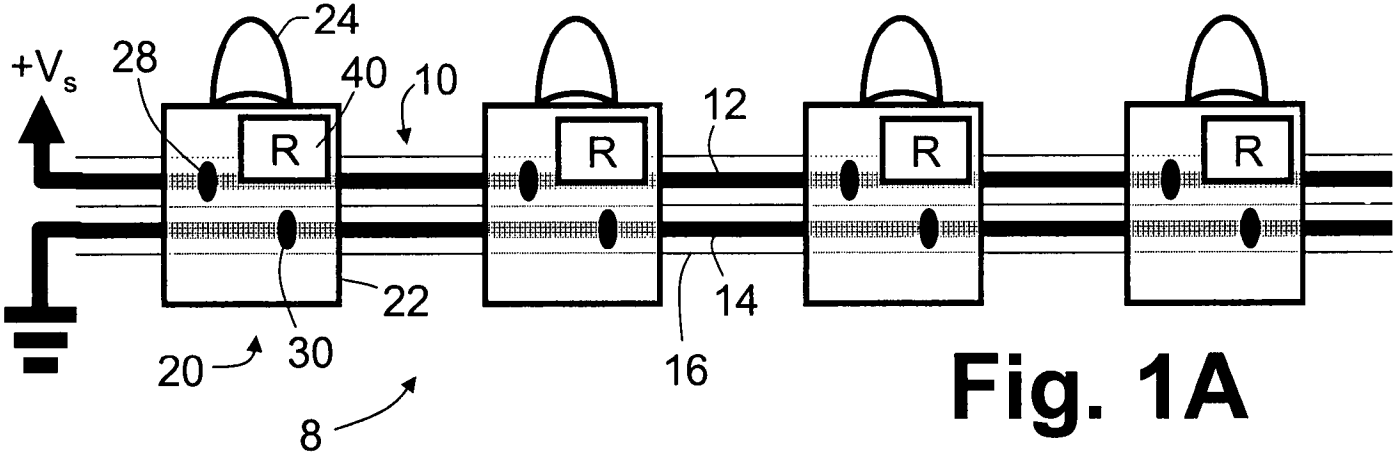
FIG. 1A diagrammatically shows a segment of a parallel lighting strip.
Figure 1B:
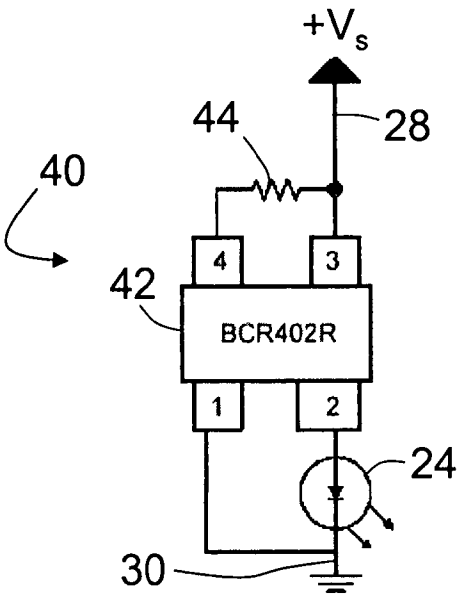
FIG. 1B shows an equivalent electrical circuit diagram using a constant current or constant voltage driver integrated circuit chip for one of the lighting units of the parallel lighting strip of FIG. 1.

With reference to FIGS. 1A and 1B, a parallel lighting strip 8 includes a flexible electrically insulated cable 10 having first and second power conductors 12, 14 electrically isolated from one another and bound together as a cable by electrical insulation 16. In the lighting strip 8, the first power conductor 12 is connected to a positive voltage denoted $V_s$ while the second power conductor 14 is connected to electrical ground, thus producing a potential difference of $V_s$ between the power conductors 12, 14. In other embodiments, a differential voltage can be applied, for example by applying $+V_s/2$ to the conductor 12 and $-V_s/2$ to the conductor 14 to produce a potential difference of $V_s$ between the power conductors 12, 14. In yet other embodiments, an a.c. single-ended or differential voltage can be applied to the power conductors 12, 14.

The lighting strip 8 further includes a plurality of lighting units 20. Four lighting units are shown; however, only the leftmost lighting unit 20 is labeled with reference numbers in FIG. 1A. Each lighting unit 20 includes a connector 22 on which is disposed a light emitting device 24, such as a light emitting diode, miniature incandescent lamp, or so forth. Each connector 22 includes a first insulation displacing conductor 28 that electrically contacts the first power conductor 12, and a second insulation displacing conductor 30 that electrically contacts the second power conductor 14. The insulation displacing conductors 28, 30 displace the electrical insulation 16 to electrically contact the power conductors 12, 14. Power regulating circuitry 40 is also disposed on or in each of the connectors 22 so that each lighting unit 20 has its own electrical power regulation.

With particular reference to FIG. 1B which shows an electrical schematic representation of one of the lighting units 20. Each of the lighting units 20 includes the power regulating circuitry 40 which in the illustrated embodiment of FIGS. 1A and 1B includes an integrated circuit power regulator component 42 and a passive resistor 44 interconnected with the integrated circuit power regulator component 42 such that the integrated circuit power regulator component produces one of a constant current output and a constant voltage output. In the illustrated embodiment, the integrated circuit power regulator component 42 is a BCR402R LED driver (available from Infineon Technologies AG, Munich, Germany) that outputs a constant current between output pin 2 and ground with the current level controlled by the resistor 44 connected between pins 3 and 4. Input pin 3 is also connected to the first power conductor 12 via the first insulation displacing conductor 28 to receive input voltage $V_s$. The light emitting device 24 is electrically connected between the output pin 2 and the ground potential provided by the second power conductor 14 via the second insulation displacing conductor 30. The resistor 44 is selected to provide the desired regulated constant current level.

Figure 2A:
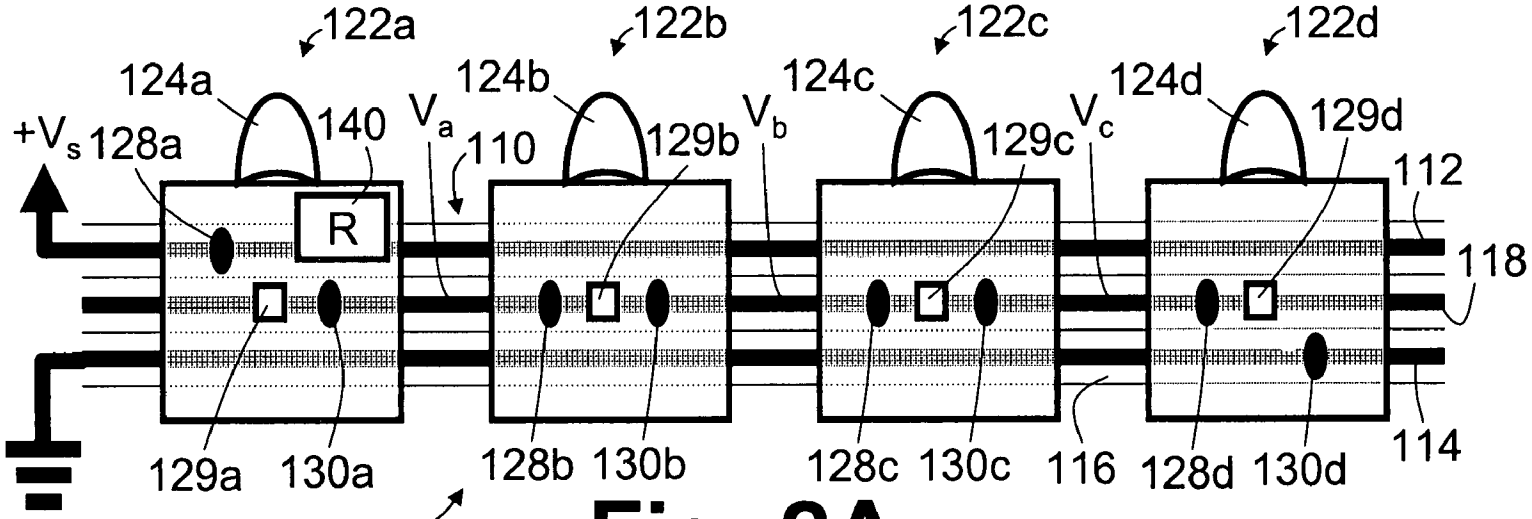
FIG. 2A diagrammatically shows a lighting unit of a series/parallel lighting strip.
Figure 2B:
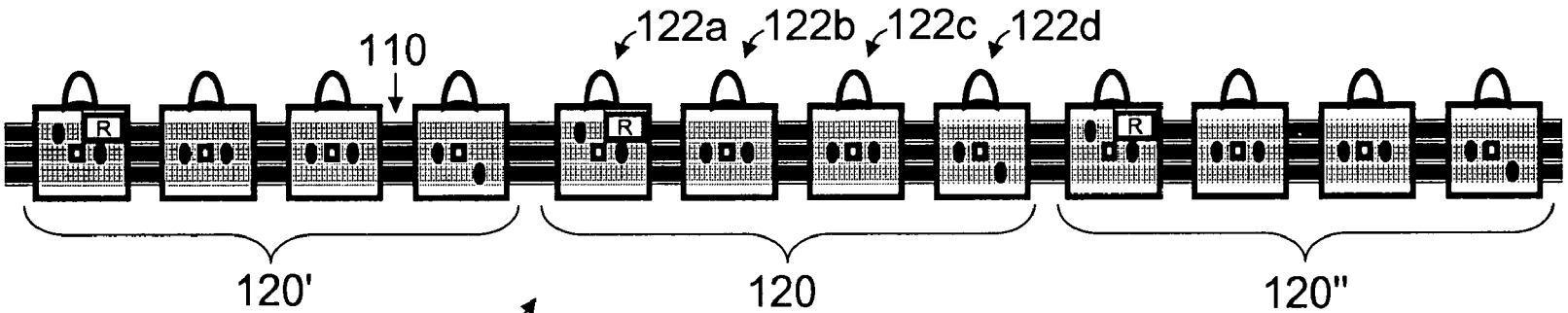
FIG. 2B diagrammatically shows a portion of the series/parallel lighting strip including three lighting units.
Figure 3C:
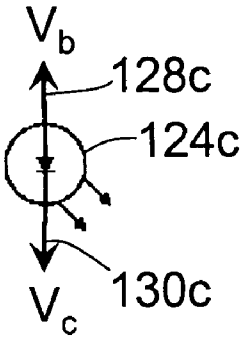
FIG. 3C shows an equivalent electrical circuit diagram for the second series connector of the lighting unit of FIG. 2A.
Figure 3B:
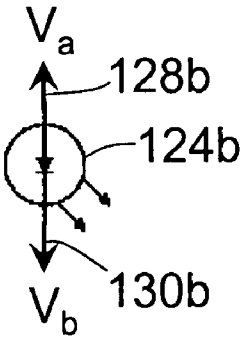
FIG. 3B shows an equivalent electrical circuit diagram for the first series connector of the lighting unit of FIG. 2A.
Figure 3D:
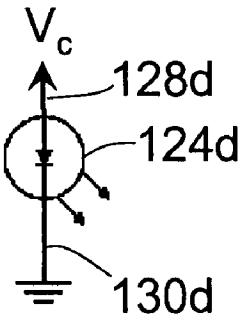
FIG. 3D shows an equivalent electrical circuit diagram for the second terminating connector of the lighting unit of FIG. 2A.
Figure 3A:
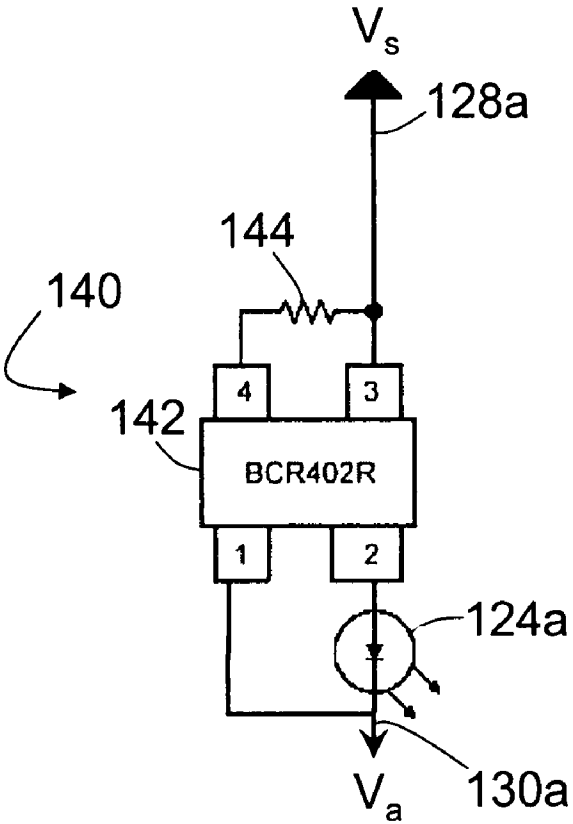
FIG. 3A shows an equivalent electrical circuit diagram for the first terminating connector of the lighting unit of FIG. 2A on which the power regulating circuitry is disposed.

With reference to FIGS. 2A and 2B, a series-parallel lighting strip 80 includes a flexible electrically insulated cable 100 having first and second power conductors 112, 114 electrically isolated from one another and bound together as a cable by electrical insulation 116. Unlike the cable 10, the cable 100 includes a third series conductor 118. In the lighting strip 80, the first power conductor 112 is connected to a positive voltage denoted $V_s$ while the second power conductor 114 is connected to electrical ground, thus producing a potential difference of $V_s$ between the power conductors 112, 114. In other embodiments, a differential voltage can be applied, or an a.c. single-ended or differential voltage can be applied to the power conductors 112, 114.

The lighting strip 80 further includes a plurality of lighting units 120. Each lighting unit 120 includes a plurality of subunits supported or housed by connectors 122*a*, 122*b*, 122*c*, 122*d*. Light emitting devices 124*a*, 124*b*, 124*c*, 124*d* are disposed on the connectors 122*a*, 122*b*, 122*c*, 122*d*, respectively. The connector 122*a* is a first terminating connector and includes a first electrically insulation displacing conductor 128*a* that electrically contacts the first power conductor 112, and a second insulation displacing conductor 130*a* that electrically contacts the series conductor 118. An interruption 129*a* in the series conductor 118 arranged to the left of the insulation displacing conductor 130*a* electrically isolates the lighting unit 120 from a neighboring lighting unit 120' to the left of the lighting unit 120 (see FIG. 2B).

The connector 122*b* is a series connector and includes first and second insulation displacing conductors 128*b*, 130*b* that electrically contact the series conductor 118. An interruption 129*b* in the series conductor 118 arranged between the insulation displacing conductors 128*b*, 130*b* electrically isolates the insulation displacing conductors 128*b*, 130*b* from one another. The connector 122*c* is another series connector and includes first and second insulation displacing conductors 128*c*, 130*c* that electrically contact the series conductor 118. An interruption 129*c* in the series conductor 118 arranged between the insulation displacing conductors 128*c*, 130*c* electrically isolates the insulation displacing conductors 128*c*, 130*c* from one another.

The connector 122*d* is a second terminating connector and includes a first insulation displacing conductor 128*d* that electrically contacts the series conductor 118, and a second insulation displacing conductor 130*d* that electrically contacts the second power conductor 114. An interruption 129*d* in the series conductor 118 arranged to the right of the insulation displacing conductor 128*d* electrically isolates the lighting unit 120 from a neighboring lighting unit 120" to the right of the lighting unit 120 (see FIG. 2B). The skilled artisan will recognize from FIG. 2B that inclusion of both interruptions 129*a*, 129*d* is redundant, and that one or the other can optionally be omitted. Both interruptions are optionally included in the design for simplicity during manufacturing and symmetry in design. The series connectors 122*b*, 122*c* are arranged between the terminating connectors 122*a*, 122*d*.

With continuing reference to FIGS. 2A and 2B, the interruptions 129*a*, 129*d* electrically isolate the portion of the series conductor 118 corresponding with the lighting unit 120 from portions of the series conductor 118 to the left and right of the lighting unit 120. The interruptions 129*b*, 129*c* provide for three stepped voltage levels, labeled $V_a$, $V_b$, and $V_c$ in FIG. 2A, along the portion of the electrically disjointed series conductor 118 demarcated by the interruptions 129*a*, 129*d*. The voltage $V_a$ is present along that portion of the series conductor 118 lying between the interruptions 129*a*, 129*b*, that is, between the connectors 122*a*, 122*b*. The voltage $V_b$ is present along that portion of the series conductor 118 lying between the interruptions 129*b*, 129*c*, that is, between the connectors 122*b*, 122*c*. The voltage $V_c$ is present along that portion of the series conductor 118 lying between the interruptions 129*c*, 129*d*, that is, between the connectors 122*c*, 122*d*. The lighting unit 120 has its connectors 122*a*, 122*b*, 122*c*, 122*d* connected in series between the power conductors 112, 114, with the series sequence being:

$$+V_s\text{-}122a\text{-}V_a\text{-}122b\text{-}V_b\text{-}122c\text{-}V_c\text{-}122d\text{-Ground}$$

where the reference numbers 122*a*, 122*b*, 122*c*, 122*d* in the above sequence denote the relative positions of the connectors 122*a*, 122*b*, 122*c*, 122*d* in the electrical series interconnection of the lighting unit 120.

FIGS. 3A, 3B, 3C, and 3D show electrical schematic representations of the connectors 122*a*, 122*b*, 122*c*, 122*d*, respectively. Power regulating circuitry 140 is disposed on or in the first terminating connector 122*a* to provide power regulation for the lighting unit 120. Because the four connectors 122*a*, 122*b*, 122*c*, 122*d* are connected in series, there is no power regulating circuitry for the remaining three connectors 122*b*, 122*c*, 122*d*. Rather, the power regulating circuitry 140 produces a common constant current level that flows through all four connectors 122*a*, 122*b*, 122*c*, 122*d*. In the illustrated embodiment of FIG. 3A, the power regulating circuitry 140 includes an integrated circuit power regulator component 142 and a passive resistor 144 interconnected with the integrated circuit power regulator component 142 such that the integrated circuit power regulator component produces one of a constant current output and a constant voltage output. In the illustrated embodiment, the integrated circuit power regulator component 142 is a BCR402R LED driver (available from Infineon Technologies AG, Munich, Germany) that outputs a constant current between output pin 2 and ground with the current level controlled by the resistor 144 connected between pins 3 and 4. Input pin 3 is also connected to the first power conductor 112 via the first insulation displacing conductor 128*a* to receive input voltage $V_s$. The light emitting device 124*a* is electrically connected between the output pin 2 and the ground potential provided by the second power conductor 114 via the second insulation displacing conductor 130*a*. The resistor 144 is selected to provide the desired regulated constant current level.

The constant current flow provided by the power regulating circuitry 140 can drive substantially any number of connectors arranged electrically in series. Thus, while the illustrated lighting unit 120 includes two series connectors 122*b*, 122*c*, the series can include no series connectors, one series connector, or more than two series connectors. The number of series connectors in the lighting unit is limited by the loading capability of the selected power regulating circuitry disposed on the first terminating connector of the series.

Figure 4:
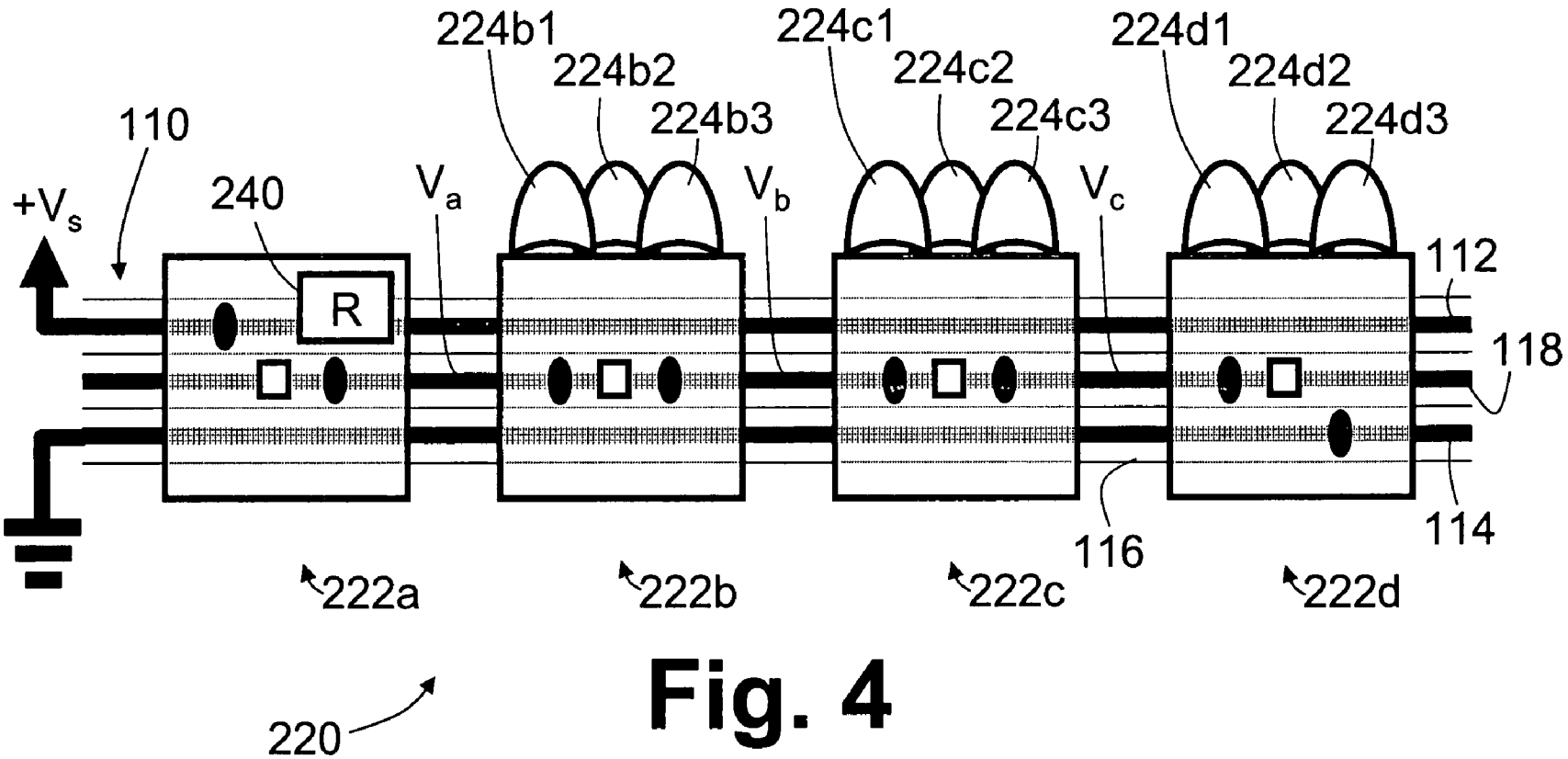
FIG. 4 diagrammatically shows another lighting unit suitable for use in a series/parallel lighting strip.

With reference to FIG. 4, another lighting unit 220 for a series-parallel lighting strip is similar to the lighting unit 120, and includes the flexible electrically insulated cable 100 having the first and second power conductors 112, 114 connected with a voltage $V_s$ and electrical ground respectively, the electrical insulation 116, and the series conductor 118. The lighting unit 220 further includes a plurality of series connected sub-units supported or housed by connectors 222*a*, 222*b*, 222*c*, 222*d* that are series-interconnected similarly to the series connectors 122*a*, 122*b*, 122*c*, 122*d* of the lighting strip 80.

The lighting unit 220 differs from the lighting unit 120 in the arrangement of light emitting devices on the connectors 222*a*, 222*b*, 222*c*, 222*d*. In the lighting unit 220, the first terminating connector 222*a* has no light emitting devices disposed thereon. Rather, the connector 222*a* serves only as a power-regulating component of the lighting unit 220. The remaining connectors 222*b*, 222*c*, 222*d* each have three light emitting devices disposed thereon. The connector 222*b* has light emitting devices 224*b*1, 224*b*2, 224*b*3 disposed thereon; the connector 222*c* has light emitting devices 224*c*1, 224*c*2, 224*c*3 disposed thereon; and the connector 222*d* has light emitting devices 224*d*1, 224*d*2, 224*d*3 disposed thereon.

Figure 5B:
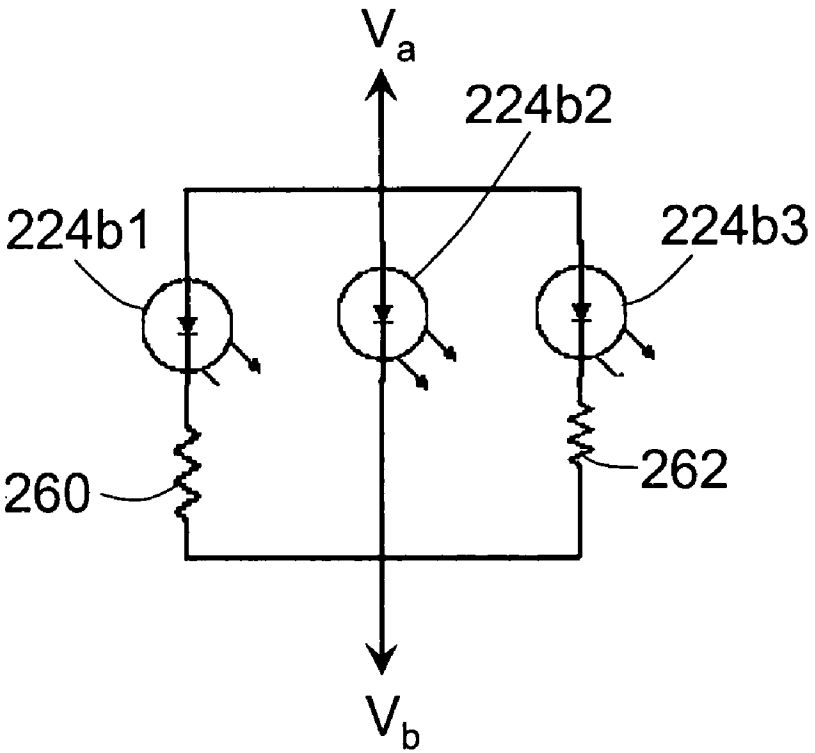
FIG. 5B shows an equivalent electrical circuit diagram for the first series connector of the lighting unit of FIG. 4.
Figure 5A:
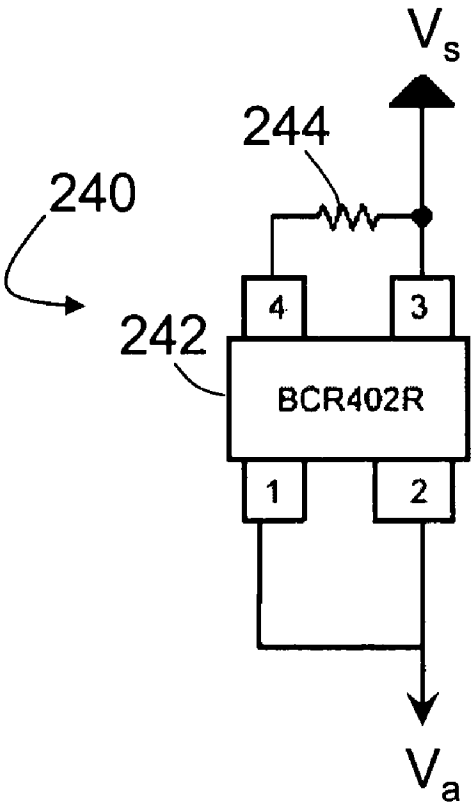
FIG. 5A shows an equivalent electrical circuit diagram for the first terminating connector of the lighting unit of FIG. 4 on which the power regulating circuitry is disposed.

With continuing reference to FIG. 4 and with further reference to FIGS. 5A and 5B which show electrical schematic representations of the connectors 222*a*, 222*b*, respectively, power regulating circuitry 240 is disposed on or in the first terminating connector 222*a* to provide power regulation for the lighting unit 220. The power regulating circuitry 240 shown in FIG. 5A is substantially similar to the power regulating circuitry 140 shown in FIG. 3A, and includes a BCR402R IC 242 and tuning resistor 244. However, since the connector 222*a* has no light emitting devices, the constant current output from pin 2 of the BCR402R integrated circuit goes directly to the portion of the electrically disjointed series conductor 118 at which the voltage $V_a$ is present. As shown in FIG. 5B, the three light emitting devices 224*b*1, 224*b*2, 224*b*3 of the series connector 222*b* are electrically connected in parallel. In the illustrated embodiment, voltage dividing resistors 260, 262 provide that the voltages across each of the light emitting devices 224*b*1, 224*b*2, 224*b*3 is in general different. This is advantageous if, for example, the light emitting devices 224*b*1, 224*b*2, 224*b*3 are red-, green-, and blue-light emitting devices having different forward voltages and providing a composite white light output. The circuitry of FIG. 5B is an example; other interconnections of multiple light emitting devices can be used. In some embodiments, the multiple light emitting devices on a single connector may be interconnected in series, so that every light emitting device in the lighting unit receives current at the same controlled constant current level. Moreover, different connectors in the lighting unit can have different electrical configurations.

The illustrated power regulating circuitry 40, 140, 240 are examples. Those skilled in the art can readily modify the illustrated circuitry 40, 140, 240, for example by replacing the BCR402R LED driver with another integrated circuit power regulator, changing the tuning passive circuit components, or so forth. In some other contemplated embodiments, for example, an LM317 Adjustable Regulator (available from National Semiconductor Corporation, Arlington, Tex.) is used as the integrated circuit power regulator. The LM317 can be configured to provide either constant current or constant voltage power regulation. The selected power regulating circuitry preferably has a small footprint to enable the supporting connectors 22, 122*a*, 222*a* to be kept small. However, since the first terminating connector 222*a* of the lighting unit 220 does not support any light emitting devices, the footprint of the power regulating circuitry 240 of the lighting unit 220 can be relatively larger than the footprint of the power regulating circuitry 140 of the lighting unit 120.

It will be appreciated that the power regulating circuitry can be disposed on any of the modules of the series-connected lighting unit, such as on the first terminating connector as illustrated, or on the second terminating connector, or on one of the series connectors. Moreover, in some embodiments power regulating circuitry may be distributed over more than one connector. For example, constant-current power regulation circuitry may be disposed on the first terminating connector, while overload safety circuitry may be disposed on the second terminating connector.

The example illustrated power regulating circuitry 40, 140, 240 each output a constant driving electrical current. Constant current operation is generally preferred for light emitting devices such as light emitting diodes, since light output at constant current is less temperature-dependent than light output at constant voltage. Thus, as the light emitting devices heat up due to heat dissipation during operation, the constant current operation maintains light output at a substantially constant level.

Figure 6A:
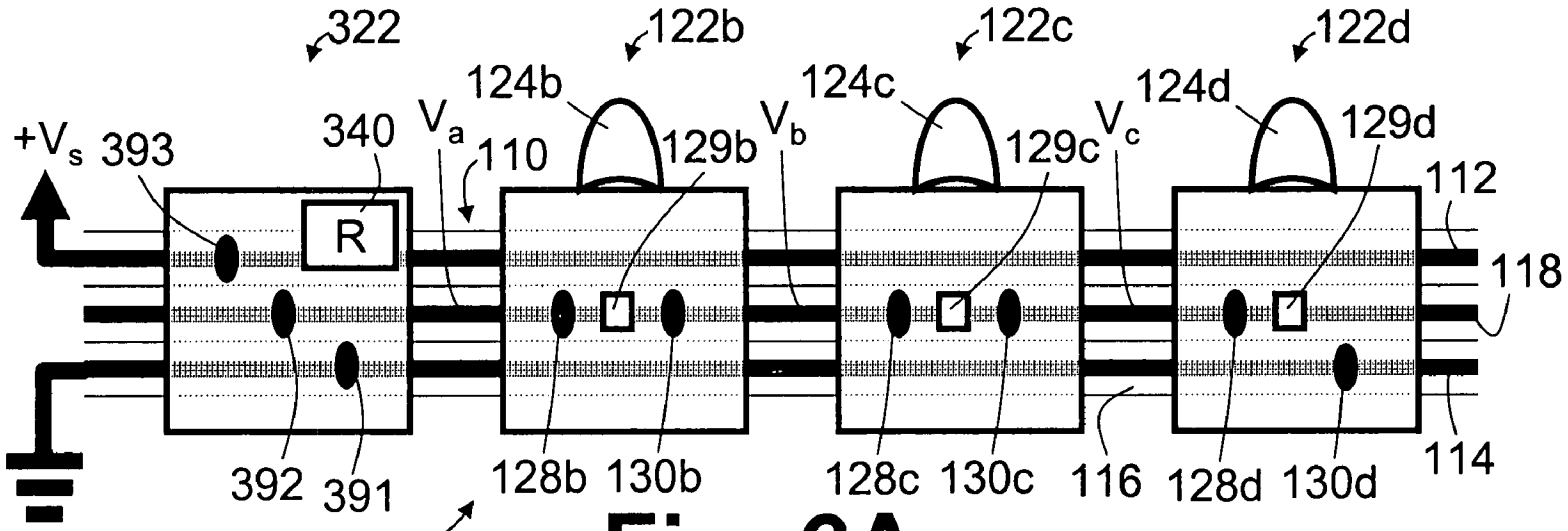
FIG. 6A diagrammatically shows another lighting unit embodiment for a series/parallel lighting strip.
Figure 6B:
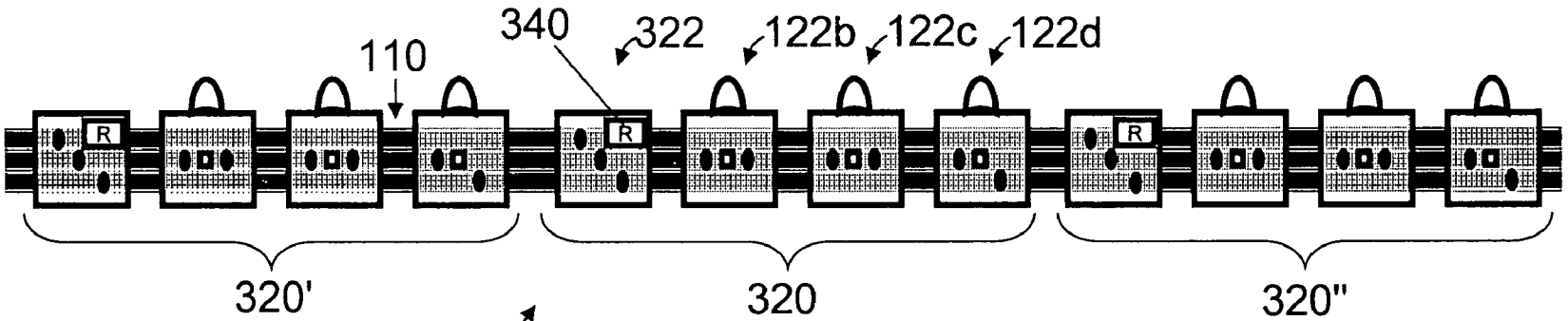
FIG. 6B diagrammatically shows a series/parallel lighting strip constructed by repetitions of the lighting unit of FIG. 6A.

With reference to FIGS. 6A and 6B, a modified version 320 of the lighting unit 120 of FIG. 2A and a modified version 380 of the series-parallel lighting strip 80 of FIG. 2B, respectively, is illustrated. The lighting unit 320 differs from the lighting unit 120 by a first terminating sub-unit or connector 322 substituting for the first terminating sub-unit or connector 122*a* that (i) omits the light emitting device 124*a* and the interruption 129*a*, and (ii) has modified power regulating circuitry 340 that is connected with the ground conductor 114.

Figure 7B:
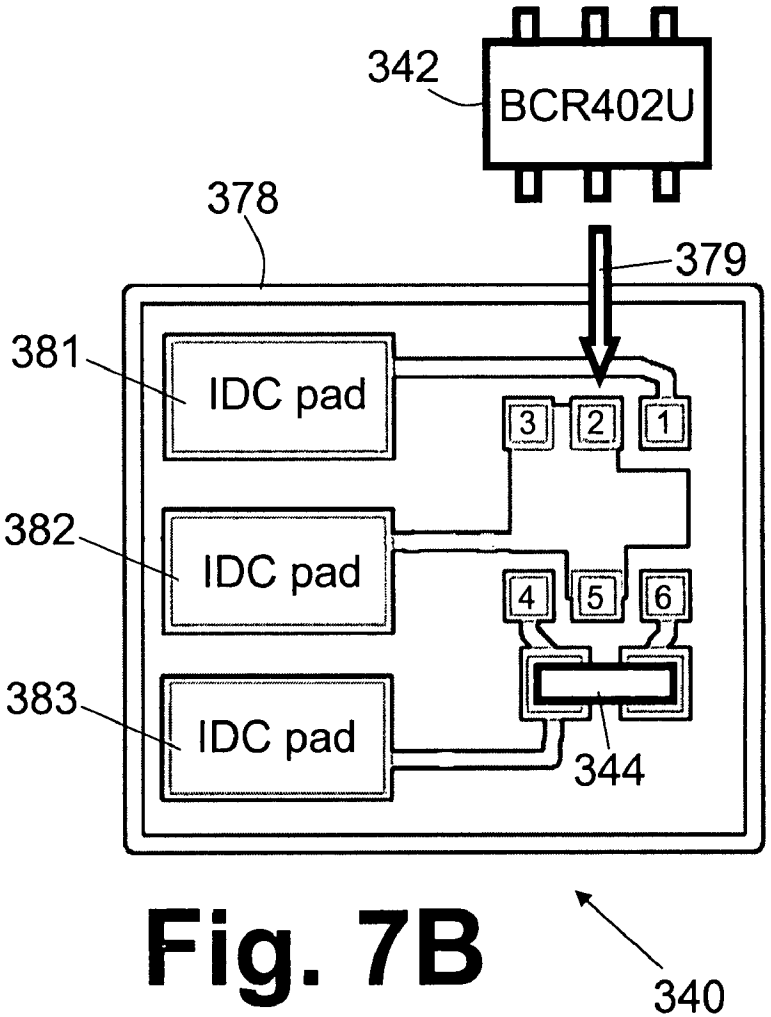
FIG. 7B shows a suitable physical layout for the power regulating circuitry of the first terminating connector of the lighting unit of FIG. 6A.
Figure 7A:
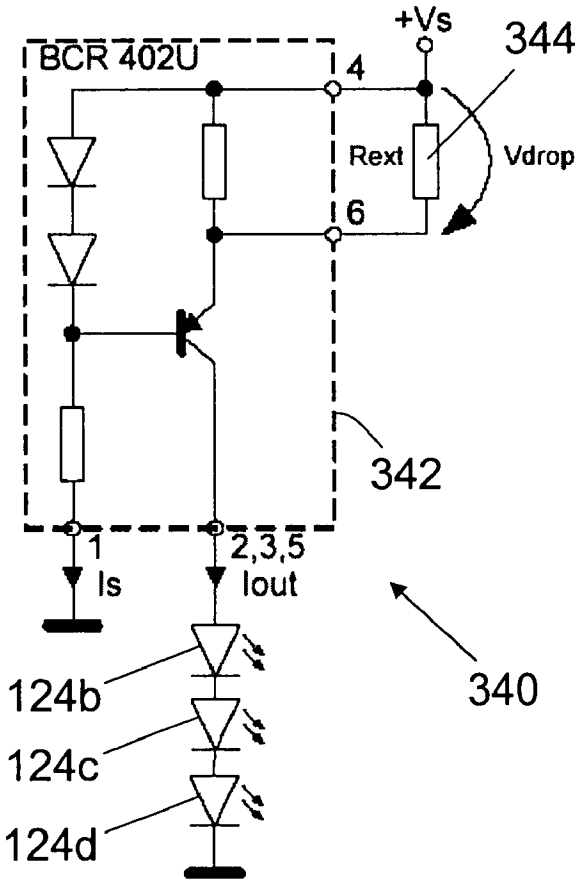
FIG. 7A shows an equivalent electrical circuit diagram for the first terminating connector of the lighting unit of FIG. 6A on which the power regulating circuitry is disposed.

With reference to FIGS. 7A and 7B, the power regulating circuitry 340 employs the BCR402U integrated circuit (IC) 342 whose functional electrical diagram is shown in FIG. 7A, and whose six-pin dual in-line package (DIP) configuration is shown in FIG. 7B. A discrete resistor component 344 is connected between pins four and six of the DIP package BCR402U IC 342. The pins of the DIP package BCR402U IC 342 are suitably soldered to a corresponding set of six pads, or insert into a six-pin DIP socket, of a printed circuit board 378 (soldering or DIP package socket insertion diagrammatically indicated in FIG. 7B by arrow 379). As shown, the printed circuit board 378 includes printed circuitry for connecting the soldered or inserted pins of the DIP package BCR402U IC 342 to the resistor 344 and to electrical contact pads 381, 382, 383. Printed circuitry connects the electrical contact pad 381 connects with ground pin 1 of the BCR402U IC 342. Printed circuitry connects the electrical contact pad 382 connects with pins 2, 3, and 5 of the BCR402U IC 342. Printed circuitry connects the electrical contact pad 383 connects with pin 4 of the BCR402U IC 342, and defines solder pads for soldering the discrete resistor 344 across pins 4 and 6 of the BCR402U IC 342.

Figure 8:
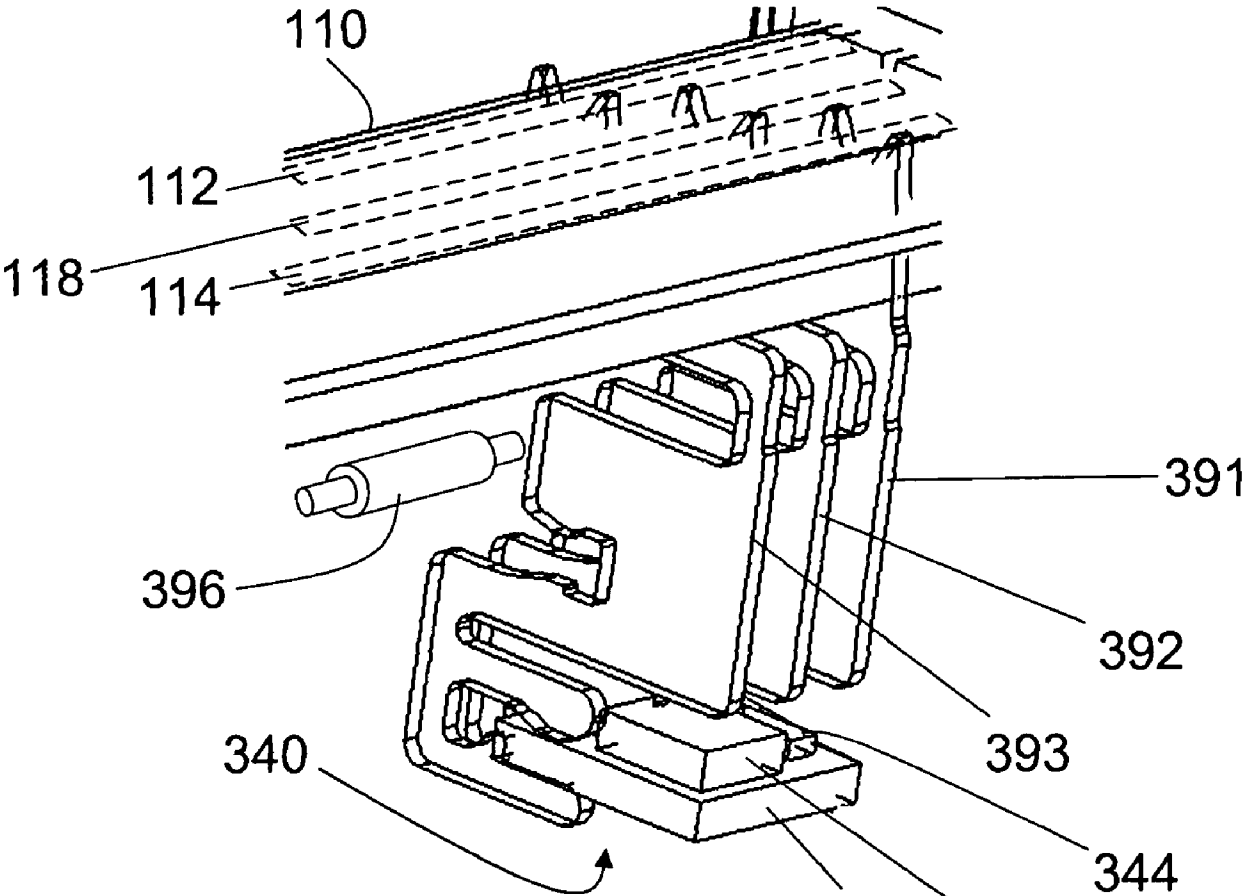
FIG. 8 shows the printed circuit board supporting the power regulating circuitry of the first terminating connector of the lighting unit of FIG. 6A secured by friction-fit to insulating displacing conductors (IDC's) of the first terminating connector.

With continuing reference to FIGS. 6A, 6B, 7A, and 7B, and further reference to FIG. 8, the printed circuit board 378 is frictionally held by insulation-displacing connectors (IDC's) 391, 392, 393 of the first terminating connector 322. In the illustrated embodiment, the electrical contact pads 381, 382, 383 of the printed circuit board 378 connect with corresponding friction-securing slots of the respective IDC's 391, 392, 393, respectively, of the module. The IDC's 391, 392, 393 connect with the three-conductor cable 110 by insulation displacement connection, so that pin 1 of the BCR402U IC 342 is connected with the electrical ground conductor 114, pin 4 of the BCR402U IC 342 is connected with the electrical conductor 112 carrying the voltage $+V_s$, and pins 2, 3, and 5 of the BCR402U IC 342 is connected with the third series conductor 118. With particular reference to FIG. 6B, it will be noted that the interruption 129*d* of the second terminating connector 122*d* provides electrical isolation between the lighting unit 320 and a subsequent identical lighting unit 320", while a previous identical lighting unit 320' is electrically isolated from the lighting unit 320 by the interruption 129*d* of the previous identical lighting unit 320'. Optionally, a discrete zener diode component 396 is friction held by friction-securing slots of the IDC's 391, 393 to provide current-limiting protection for the power regulating circuitry 340. (In FIG. 8, the zener diode 396 is shown detached from the friction-securing slots for improved visibility). Similarly, a discrete zener diode component (not shown) can be placed across the insulation displacing conductors 128*b*, 130*b* of the connector 122*b*, or so forth, to provide current limiting protection for each module of the lighting unit 320. Placing a zener diode across each light emitting device 124*b*, 124*c*, 124*d* in this manner also advantageously enables the lighting unit 320 to continue operating if one of the light emitting devices 124*b*, 124*c*, 124*d* fails.

FIG. 8 shows one suitable physical layout for power regulating circuitry. In other embodiments, the printed circuit board may be soldered to the insulation displacing conductors of the sub-unit. Manufacturability is enhanced by disposing the power regulating circuitry on a printed circuit board that is soldered, friction-fit, or otherwise electrically connected with slots of the IDC's 391, 392, 393. If a different type of LED is employed in the lighting unit, then this is readily accommodated by using a different power regulating circuitry board that solders or fits into the IDC's 391, 392, 393. It will also be appreciated that other power regulatory functions besides current limiting can be performed. For example, if the power conductors carry a.c. power, then the power regulating circuitry can include half-wave or full-wave rectification circuitry.

It will be appreciated that each lighting unit can in general have different power regulating circuitry. For example, in the series-parallel lighting strip 380 of FIG. 6B, the lighting units 320', 320" can optionally include red light emitting diodes and power regulating circuitry suitable for driving red light emitting diodes, while the lighting unit 320 can include white light emitting diodes and power regulating circuitry suitable for driving white light emitting diodes (whose power requirements may be different from the power requirements of the red light emitting diodes of the lighting units 320', 320"). In this way, a red-and-white colored lighting strip is generated.

Figure 9:
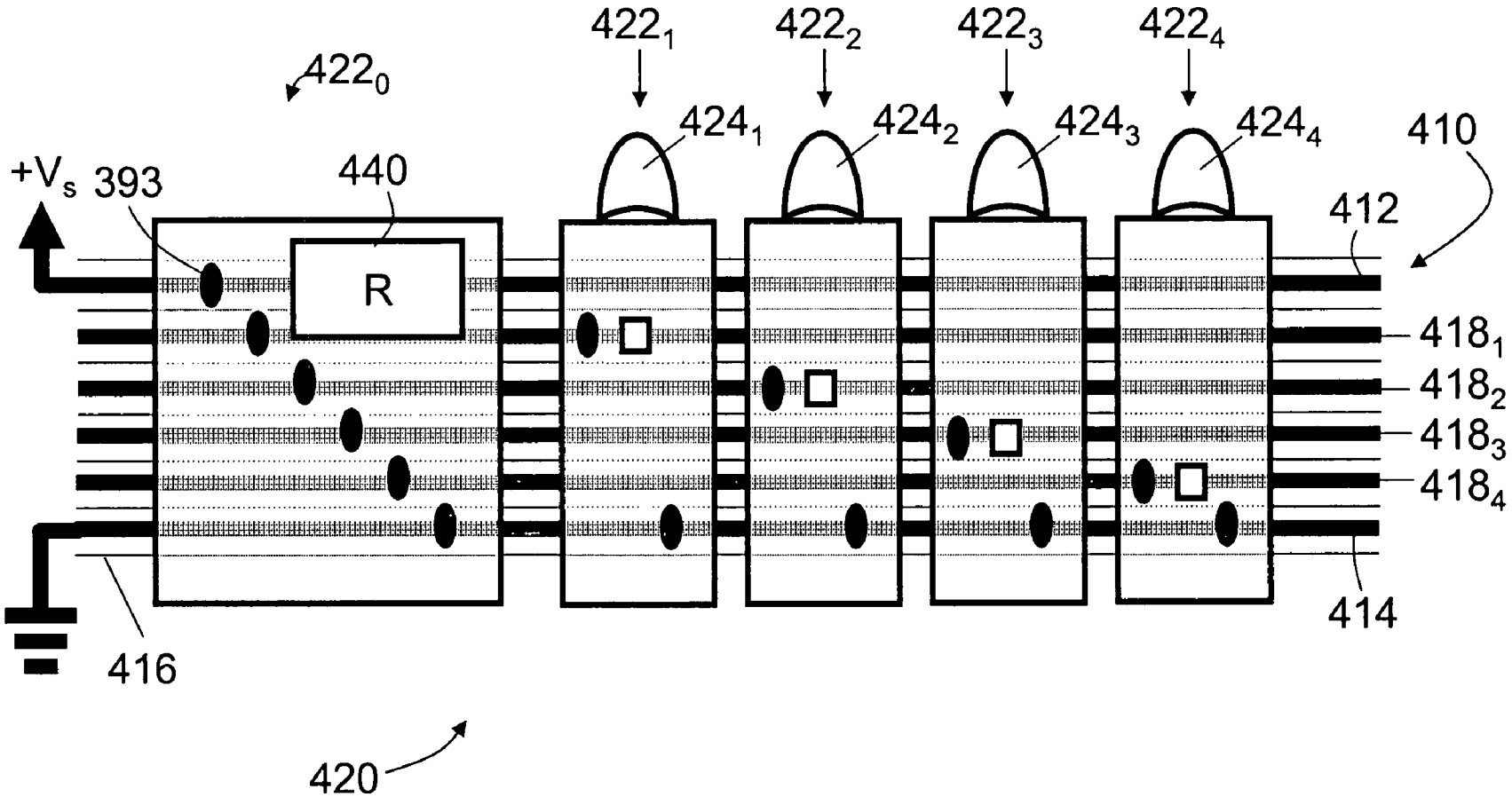
FIG. 9 diagrammatically shows another lighting unit embodiment for a series/parallel lighting strip including four independently driven series lines.
Figure 10:
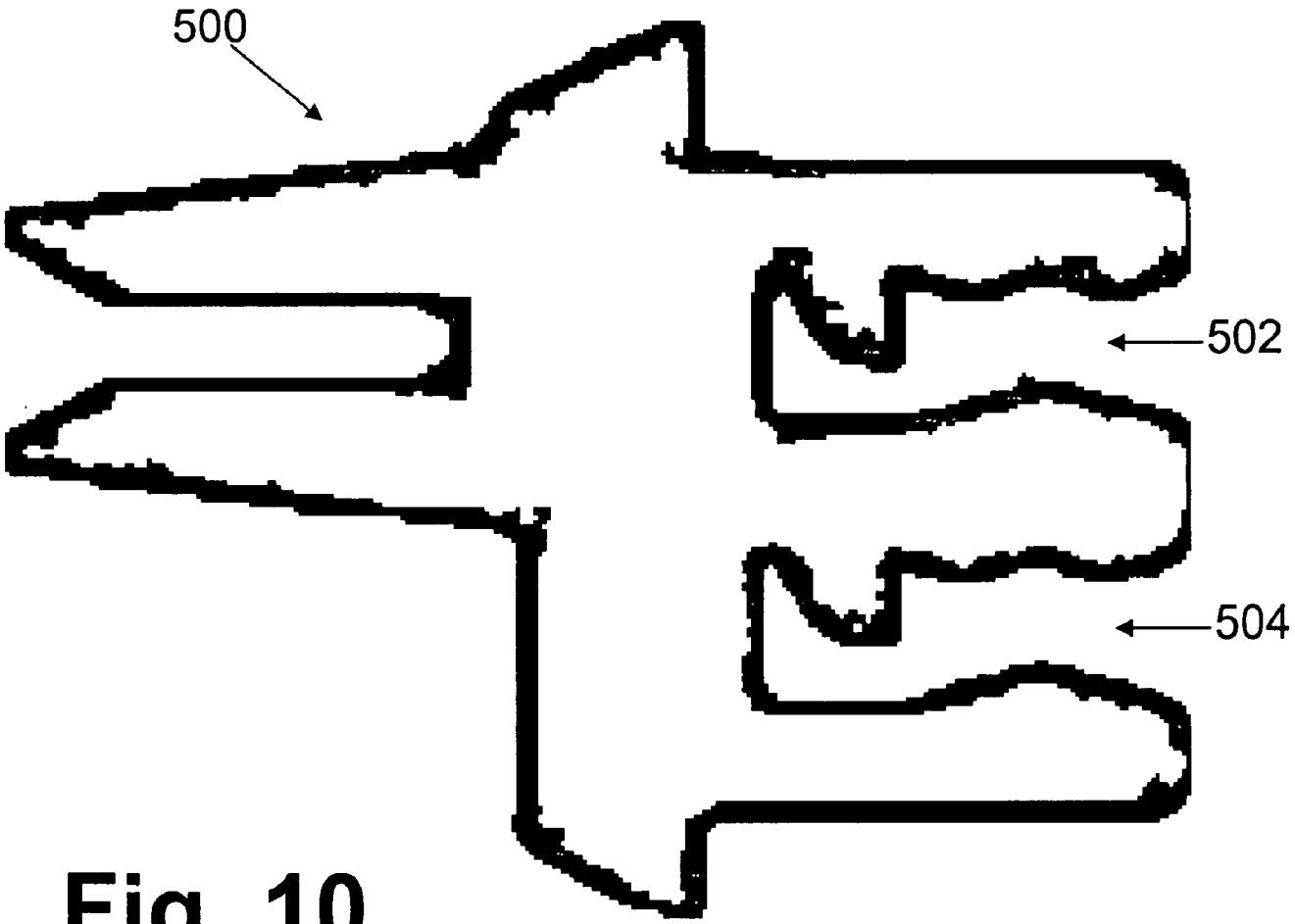
FIG. 10 shows an interchangeable insulation displacing conductor (IDC) suitable for connecting a printed circuit board with any of three conductors of a three-conductor flexible electrically insulated cable.
Figure 11:
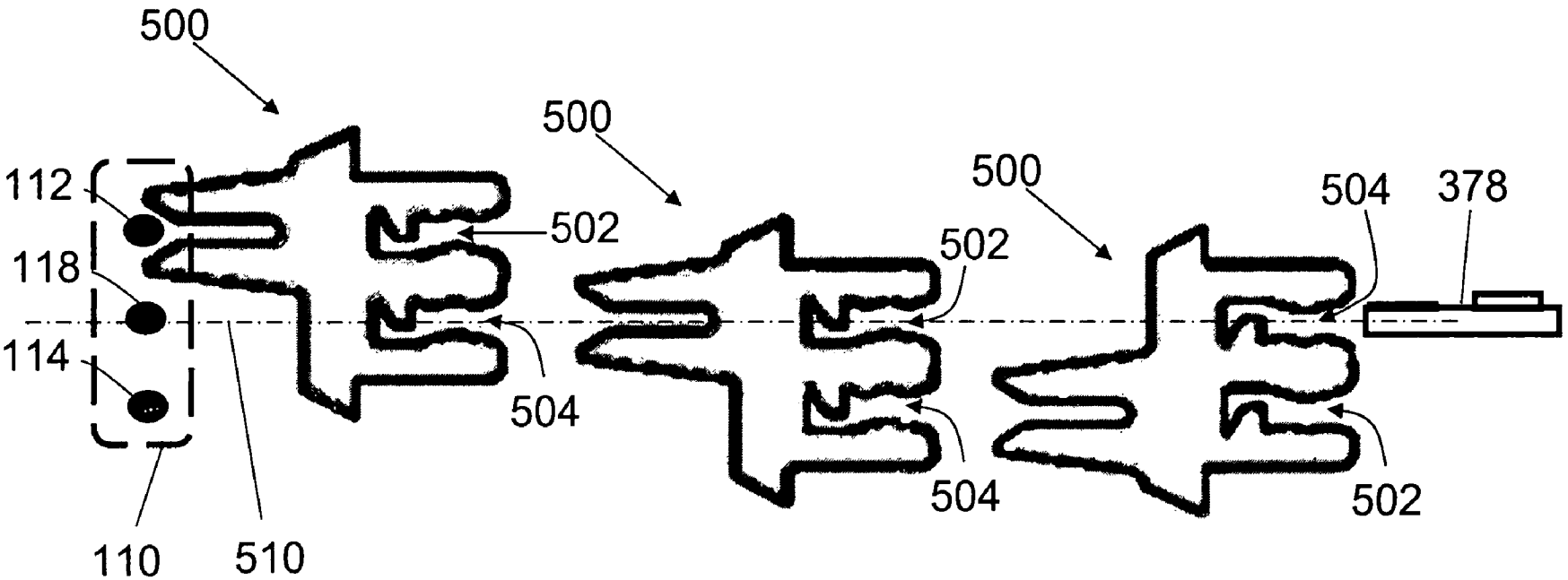
FIGS. 11-13 show how the interchangeable IDC of FIG. 10 is used to connect the printed circuit board with any of the three conductors of the three-conductor flexible electrically insulated cable.
Figure 13:
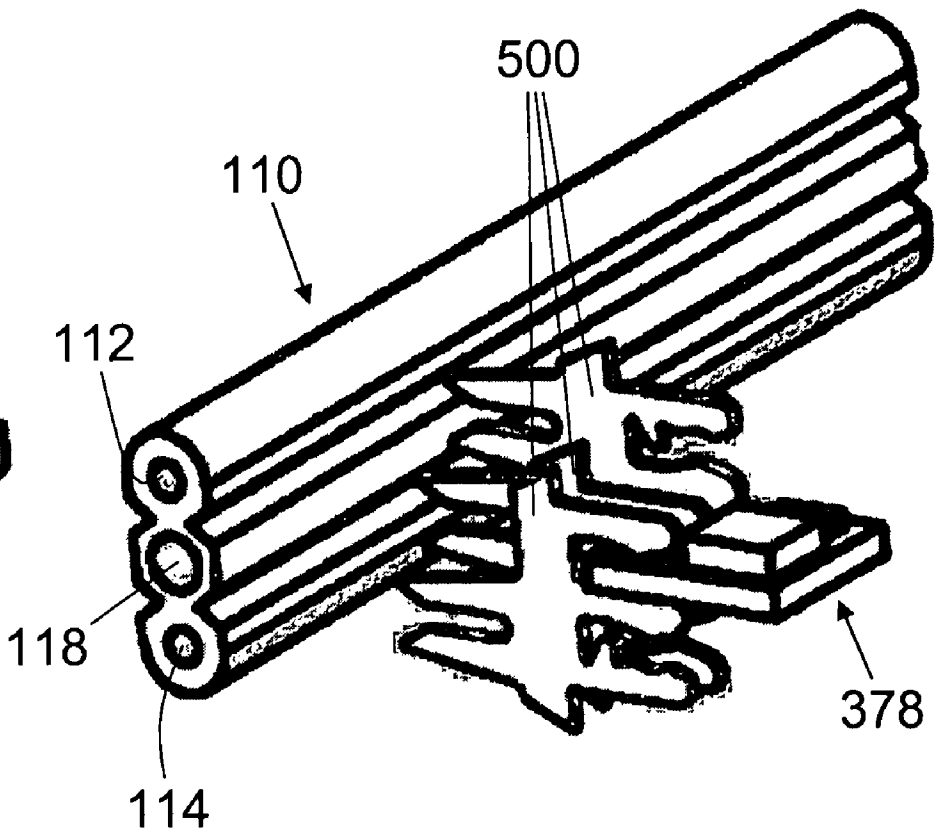
Figure 12:
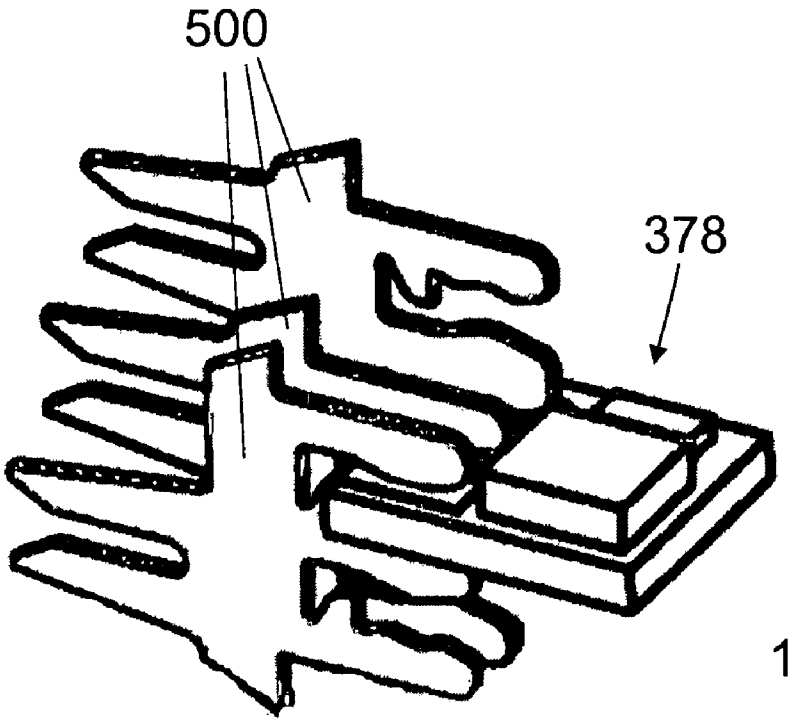

With reference to FIG. 9, the arrangement of FIGS. 6A, 6B, 7A, 7B, and 8 is readily extended to a lighting unit 420 having more than one power-regulated electrical series in the same lighting unit. In FIG. 9, a flexible electrically insulated cable 410 includes first and second power conductors 412, 414 carrying, for example, $+V_s$ and ground electrical potential, respectively, bound together as a cable by insulation 416. The cable 410 further includes four series conductors $\mathbf{418}_1$, $\mathbf{418}_2$, $\mathbf{418}_3$, $\mathbf{418}_4$ also bound by the insulation 416. A first terminating sub-unit $\mathbf{422}_0$ includes power regulating circuitry 440 which provides independent and generally different regulated power to each of the four series conductors $\mathbf{418}_1$, $\mathbf{418}_2$, $\mathbf{418}_3$, $\mathbf{418}_4$. For example, the power regulating circuitry 440 may include four circuits such as are shown in FIG. 7A, each having different values for the resistance 344 to provide different regulated power. The four circuits can be disposed on a common circuit board similar to that shown in FIG. 7B, except that the common circuit board includes space for four BCR402U DIP packages and includes six IDC pads for friction-fit to six IDC connectors that connect with the six conductors 412, 414, $\mathbf{418}_1$, $\mathbf{418}_2$, $\mathbf{418}_3$, $\mathbf{418}_4$ of the cable 410. In this way, each of the four series conductors $\mathbf{418}_1$, $\mathbf{418}_2$, $\mathbf{418}_3$, $\mathbf{418}_4$ is independently driven.

The lighting unit 420 further includes four terminating sub-units supported and/or housed by connectors $\mathbf{422}_1$, $\mathbf{422}_2$, $\mathbf{422}_3$, $\mathbf{422}_4$. The terminating connector $\mathbf{422}_1$ includes a first insulation displacing conductor connected with the series conductor $\mathbf{418}_1$ and a second insulation displacing conductor connected with the ground conductor 414. An interruption in the series conductor $\mathbf{418}_1$ at the terminating connector $\mathbf{422}_1$ provides isolation along the series conductor $\mathbf{418}_1$ of the lighting unit 420 from neighboring lighting units. A light emitting device $\mathbf{424}_1$ is disposed on the terminating connector $\mathbf{422}_1$ and receives conditioned electrical power from the series conductor $\mathbf{418}_1$. The terminating connector $\mathbf{422}_2$ includes a first insulation displacing conductor connected with the series conductor $\mathbf{418}_2$ and a second insulation displacing conductor connected with the ground conductor 414. An interruption in the series conductor $\mathbf{418}_2$ at the terminating connector $\mathbf{422}_2$ provides isolation along the series conductor $\mathbf{418}_2$ of the lighting unit 420 from neighboring lighting units. A light emitting device $\mathbf{424}_2$ is disposed on the terminating connector $\mathbf{422}_1$ and receives conditioned electrical power from the series conductor $\mathbf{418}_2$. The terminating connector $\mathbf{422}_3$ includes a first insulation displacing conductor connected with the series conductor $\mathbf{418}_3$ and a second insulation displacing conductor connected with the ground conductor 414. An interruption in the series conductor $\mathbf{418}_3$ at the terminating connector $\mathbf{422}_3$ provides isolation along the series conductor $\mathbf{418}_3$ of the lighting unit 420 from neighboring lighting units. A light emitting device $\mathbf{424}_3$ is disposed on the terminating connector $\mathbf{422}_3$ and receives conditioned electrical power from the series conductor $\mathbf{418}_3$. The terminating connector $\mathbf{422}_4$ includes a first insulation displacing conductor connected with the series conductor $\mathbf{418}_4$ and a second insulation displacing conductor connected with the ground conductor 414. An interruption in the series conductor $\mathbf{418}_4$ at the terminating connector $\mathbf{422}_4$ provides isolation along the series conductor $\mathbf{418}_4$ of the lighting unit 420 from neighboring lighting units. A light emitting device $\mathbf{424}_4$ is disposed on the terminating connector $\mathbf{422}_4$ and receives conditioned electrical power from the series conductor $\mathbf{418}_4$.

Advantageously, the light emitting devices $\mathbf{424}_1$, $\mathbf{424}_2$, $\mathbf{424}_3$, $\mathbf{424}_4$ are each independently driven by the four respective series conductors $\mathbf{418}_1$, $\mathbf{418}_2$, $\mathbf{418}_3$, $\mathbf{418}_4$, providing substantial versatility in design. Moreover, the driving circuitry for each of the four series conductors $\mathbf{418}_1$, $\mathbf{418}_2$, $\mathbf{418}_3$, $\mathbf{418}_4$ contained in the first terminating connector $\mathbf{422}_0$ optionally includes other features such as timed flashing. Optionally, one or more series sub-units (not shown) can also be included on each series conductor line between the first terminating sub-unit $\mathbf{422}_0$ and the terminating sub-unit $\mathbf{422}_1$, $\mathbf{422}_2$, $\mathbf{422}_3$, $\mathbf{422}_4$ for that series conductor.

An advantage of disposing power regulating electrical circuitry with each lighting unit, as opposed to employing power regulating circuitry operating on the lighting strip as a whole, is that the per-lighting unit power regulating circuitry can compensate for variations in resistance, failure of one or a few light emitting devices, or other localized variations in the electrical properties of the lighting strip. For example, constant current regulating circuitry applied to the lighting strip as a whole can compensate to a limited degree for a longer lighting strip by increasing voltage. However, constant current regulating circuitry applied to the lighting strip as a whole cannot compensate locally for the voltage drop along the strip. In contrast, by having constant current regulating circuitry disposed with and regulating each lighting unit, such voltage drop along the strip is readily compensated. Similarly, failure of a single light emitting device within a lighting unit typically will have a negligible effect on the lighting strip as a whole, and hence will not be compensated by power regulating circuitry applied to the lighting strip as a whole. On the other hand, power regulating circuitry associated with the lighting unit containing the failed light emitting device provides suitable compensation for the failed light emitting device.

In the illustrated embodiments, each lighting unit employs one or more sub-units in which each sub-unit includes a connector directly or indirectly supporting and/or housing the IDC's, light emitting devices, and power regulating circuitry. In some embodiments, it is contemplated to omit the connectors. For example, each sub-unit can be assembled by connecting the IDC's to the flexible electrically insulated cable, installing the optional printed circuit board and light emitting devices on the IDC's, and molding a light-transmissive material over the assembled sub-unit. Such assembly processing is readily automated. If the light strip is to be installed in a protected environment such as the inside of a channel letter, then both the connector and the molding is optionally omitted.

With returning reference to FIG. 8, a manufacturing complication is introduced by the insulation displacing conductors (IDC's) 391, 392, 393. These three types of IDC's are not interchangeable—rather, the IDC 391 must be used to connect with the conductor 114; the IDC 392 must be used to connect with the conductor 118; and the IDC 393 must be used to connect with the conductor 112. The use of three different types of IDC's arises because a different positioning of the insulation-displacing prong is called for in contacting each of the three parallel spaced apart conductors 112, 114, 118 of the flexible electrically insulating cable 110. IDC's 391, 392, 393 each have a different shape, and are not interchangeable. For mass manufacturing of lighting strips, a sufficient number of each type of IDC 391, 392, 393 must be kept in stock for the manufacturing. The "sufficient number" can be difficult to estimate, since lighting strips with relatively more series connectors may use relatively more of the IDC's 392.

With reference to FIGS. 10-13, an alternative interchangeable insulation displacing conductor (IDC) 500 is suitably substituted for the three different types of IDC's 391, 392, 393. The same interchangeable IDC 500 can be used to connect the printed circuit board 378 with any of the three conductors 112, 114, 118 of the flexible electrically insulated cable 110. The interchangeable IDC 500 includes two slots 502, 504 for receiving the printed circuit board 378. FIGS.

11-13 show how the single interchangeable type of IDC 500 can connect the printed circuit board 378 with any of the three conductors 112, 114, 118 of the flexible electrically insulated cable 110. For connection to the conductor 112, the lower slot 504 is mated to the printed circuit board 378. For connection to the series conductor 118, the upper slot 502 is mated to the printed circuit board 378. For connection to the conductor 114, the upper slot 502 is mated to the printed circuit board 378 with the IDC 500 flipped respective to its position when connecting with the series conductor 118. (In FIG. 11, a dot-dashed horizontal line 510 indicates the position or elevation of the printed circuit board 378.) Thus, only the single type of IDC 500 is kept in stock, and can be interchangeably used to connect the printed circuit board 378 with any of the three conductors 112, 114, 118 of the flexible electrically insulated cable 110.

Figure 14:
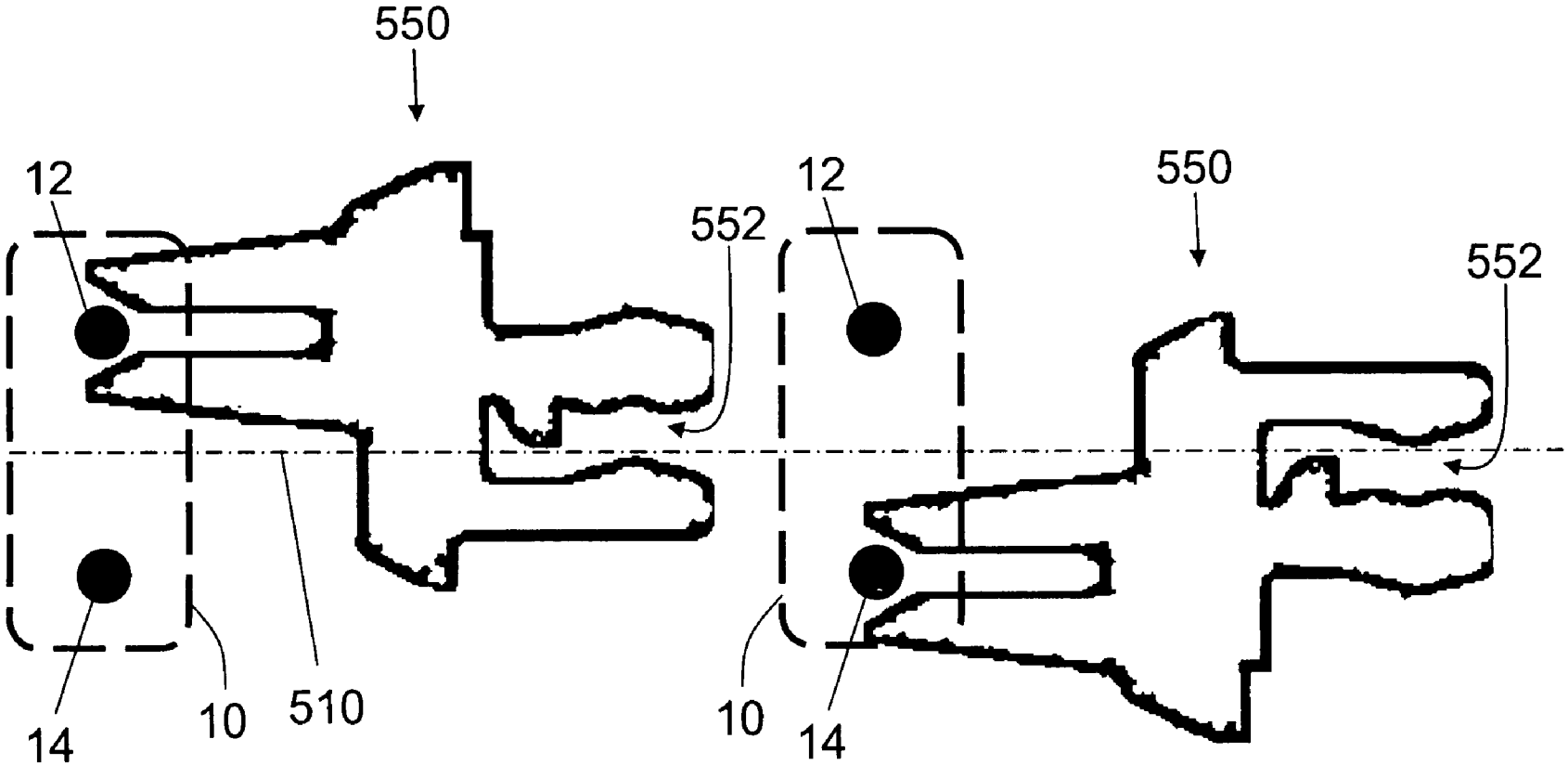
FIG. 14 shows selectable connection of another interchangeable insulation displacing conductor (IDC) with either of two conductors of a two-conductor flexible electrically insulated cable.

With reference to FIG. 14, another embodiment of an interchangeable insulation displacing conductor (IDC) 550 is suitable for connecting to either conductor 12, 14 of the two-conductor flexible electrically insulated cable 10. Here, only a single slot 552 is provided for mating with the printed circuit board, and connection to either conductor 12, 14 is achieved by flipping the IDC 550. (In FIG. 14, the dot-dashed horizontal line 510 again indicates the position or elevation of the printed circuit board 378.)

Figure 15:
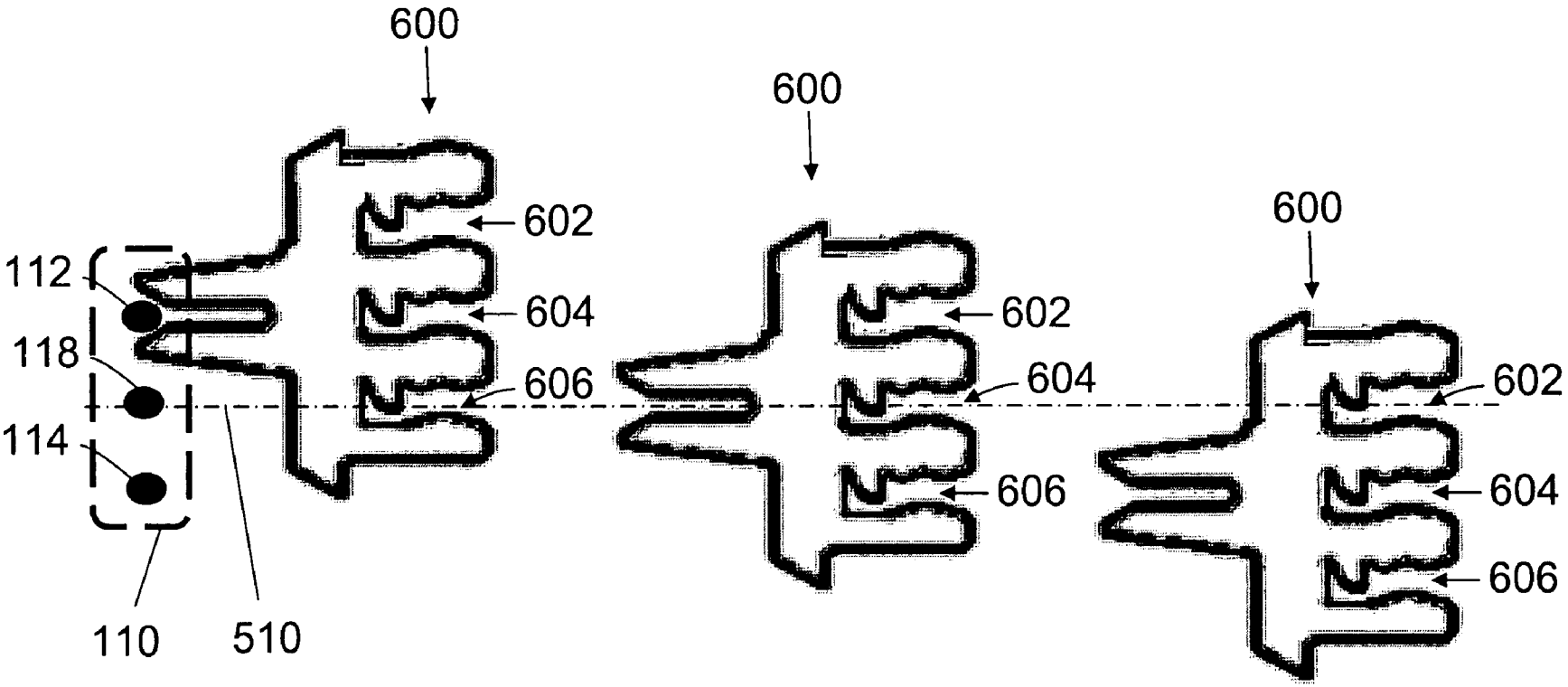
FIG. 15 shows selectable connection of yet another interchangeable insulation displacing conductor (IDC) with any of three conductors of a three-conductor flexible electrically insulated cable.

With reference to FIG. 15, another embodiment of an interchangeable insulation displacing conductor (IDC) 600 is suitable for connecting to any conductor 112, 114, 118 of the three-conductor flexible electrically insulated cable 110. Here, three slot 602, 604, 606 are provided for mating with the printed circuit board, and connection to any conductor 112, 114, 116 is achieved by using the appropriate one of the three slots 602, 604, 606. (In FIG. 15, the dot-dashed horizontal line 510 again indicates the position or elevation of the printed circuit board 378.)

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

The appended claims follow:

1. A lighting strip comprising:

a flexible electrically insulated cable including a plurality of spaced apart parallel electrical conductors bound together by electrical insulation as a cable, the electrical conductors including at least first and second power conductors and a series electrical conductor; and a plurality of lighting units secured to and spaced apart along the flexible electrically insulated cable, each lighting unit including (i) one or more light emitting devices, (ii) power regulating electrical circuitry configured to regulate electrical power delivered to the lighting unit from the power conductors of the cable, and (iii) insulation displacing conductors connecting the lighting unit with at least the first and second power conductors, each lighting unit further comprising a first terminating sub-unit including insulation displacing conductors electrically contacting at least the first power conductor and the series electrical conductor of the plurality of spaced apart parallel electrical conductors, and a second terminating sub-unit including insulation displacing conductors electrically contacting at least the second power conductor and the series electrical conductor of the plurality of spaced apart parallel electrical conductors the power regulating electrical circuitry including power regulating circuitry disposed on only one of the first or second terminating sub-unit to maintain a constant current along the portion of the series electrical conductor disposed between the first and second terminating sub-units;

wherein each lighting unit further comprises a printed circuit board on which at least the power regulating electrical circuitry is disposed.

2. The lighting strip as set forth in claim 1, wherein the power regulating electrical circuitry of each lighting unit includes:

an integrated circuit power regulator component; and at least one passive circuit element interconnected with the integrated circuit power regulator component via printed circuitry of the printed circuit board such that the integrated circuit power regulator component produces a constant current output.

3. The lighting strip as set forth in claim 1, wherein the printed circuit board is secured in friction-securing slots of the insulation displacing conductors with electrical contact pads of the printed circuit board electrically contacting the insulation displacing conductors.

4. A lighting strip comprising:

a flexible electrically insulated cable including a plurality of spaced apart parallel electrical conductors bound together by electrical insulation as a cable, the electrical conductors including at least first and second power conductors and a series electrical conductor; and a plurality of lighting units secured to and spaced apart along the flexible electrically insulated cable, each lighting unit including (i) one or more light emitting devices, (ii) power regulating electrical circuitry configured to regulate electrical power delivered to the lighting unit from the power conductors of the cable, and (iii) insulation displacing conductors connecting the lighting unit with at least the first and second power conductors, each lighting unit further comprising a first terminating sub-unit including insulation displacing conductors electrically contacting at least the first power conductor and the series electrical conductor of the plurality of spaced apart parallel electrical conductors, and a second terminating sub-unit including insulation displacing conductors electrically contacting at least the second power conductor and the series electrical conductor of the plurality of spaced apart parallel electrical conductors, the power regulating electrical circuitry including power regulating circuitry disposed on only one of the first or second terminating sub-unit to maintain a constant current along the portion of the series electrical conductor disposed between the first and second terminating sub-units.

5. The lighting strip as set forth in claim 4, wherein each lighting unit further comprises:

one or more series sub-units disposed between the first and second terminating sub-units, each series sub-unit including insulation displacing conductors electrically contacting the series electrical conductor and the series electrical conductor having an interruption corresponding to each series sub-unit that electrically isolates insulation displacing conductors of that series sub-unit from one another, each series connector having the constant current flowing therethrough and having at least one of the one or more light emitting devices disposed thereon.

6. The lighting strip as set forth in claim 5, wherein the series sub-units do not include power regulating electrical circuitry.

7. The lighting strip as set forth in claim 5, wherein each of the first and second terminating sub-units and the series sub-units comprises:

a connector supporting at least the insulation displacing conductors.

8. A lighting strip comprising:

a flexible electrically insulated cable including at least three spaced apart parallel electrical conductors bound together by electrical insulation, the electrical conductors including at least first and second power conductors and a series conductor; and a plurality of lighting units secured to and spaced apart along the flexible electrically insulated cable, each lighting unit including:

a plurality of connectors secured to and spaced apart along the flexible electrically insulated cable and electrically connected in series across the first and second power conductors by the series conductor, the plurality of connectors supporting a plurality of light emitting diodes arranged to receive electrical operating power from the first and second power conductors via the electrical series connection, and constant-current regulating circuitry configured to maintain a constant electrical current through the electrical series connection, the constant-current regulating circuitry being disposed on only one connector of the plurality of connectors.

9. The lighting strip as set forth in claim 8, wherein the one or more light emitting devices of each lighting unit include a plurality of light emitting diodes emitting light of the same or different colors.

10. The lighting strip as set forth in claim 8, wherein the power regulating electrical circuitry of each lighting unit includes:

an integrated circuit power regulator component; and at least one passive circuit element electrically communicating with the integrated circuit power regulator component.

11. The lighting strip as set forth in claim 8, wherein the insulation displacing conductors of each lighting unit comprise:

a plurality of insulation displacing conductors of the same shape contacting at least two different conductors of the spaced apart parallel electrical conductors.

12. The lighting strip as set forth in claim 8, wherein the insulation displacing conductors of each lighting unit comprise:

a plurality of interchangeable insulation displacing conductors contacting at least two different conductors of the spaced apart parallel electrical conductors.

13. The lighting strip as set forth in claim 8, wherein the connector of each lighting unit on which the constant-current regulating circuitry is disposed further comprises:

a printed circuit board on which at least the constant-current regulating circuitry is disposed.

14. The lighting strip as set forth in claim 8, wherein the constant-current regulating circuitry of each lighting unit comprises:

an integrated circuit power regulator component configured to maintain a constant electrical current through the electrical series connection.

15. The lighting strip as set forth in claim 8, wherein the plurality of connectors of each lighting unit further comprises:

a first connector electrically connected across the first power conductor and the series conductor; and a second connector electrically connected across the series conductor and the second power conductor.

16. The lighting strip as set forth in claim 15, wherein the plurality of sub-units of each lighting unit further comprises:

one or more series connectors disposed between the first and second connectors, each series connector being electrically connected across a gap in the series conductor.

* * * * *